United States Patent [19]

Bronson et al.

[11] Patent Number: 4,598,875

[45] Date of Patent: Jul. 8, 1986

[54] PORTABLE CRUSHING AND SCREENING PLANT

[75] Inventors: Larry D. Bronson; Egbert Couperus, both of Belleville, Canada

[73] Assignee: Allis-Chalmers Corporation, Milwaukee, Wis.

[21] Appl. No.: 241,577

[22] Filed: Mar. 9, 1981

Related U.S. Application Data

[63] Continuation of Ser. No. 122,457, Feb. 19, 1980, abandoned, which is a continuation of Ser. No. 941,084, Sep. 11, 1978, abandoned.

[51] Int. Cl.[4] ..... B02C 21/02; B02C 23/12

[52] U.S. Cl. ..... 241/78; 241/81; 241/101.7

[58] Field of Search ..... 241/78, 81, 101.7, 101.2, 241/101 R; 198/605

[56] References Cited

U.S. PATENT DOCUMENTS

| | | | |
|---|---|---|---|
| 2,593,353 | 4/1952 | Shelton, Jr. | 241/81 X |
| 3,203,632 | 8/1965 | Poynter | 241/101.7 X |
| 3,805,946 | 4/1974 | Yateman et al. | 198/605 |

*Primary Examiner*—Howard N. Goldberg
*Assistant Examiner*—Timothy V. Eley
*Attorney, Agent, or Firm*—Charles L. Schwab; Arthur M. Streich

[57] ABSTRACT

This invention relates to a vehicle-mounted closed circuit portable crushing and screening plant in which a plurality of units for processing material to be crushed, such as a grizzly, a primary crusher, and a secondary crusher are mounted to discharge their outputs onto the horizontal feeder portion of a dual belt conveyor-elevator having an elevator portion which receives the deposited material from the horizontal feeder portion and elevates such material to and discharges such material into the upper feed end of a vibrating screen device mounted on the vehicle. The vibrating screen device classifies the material deposited thereon for recirculation to the secondary crusher and/or for discharge as a plurality of end products of predetermined size classifications. The vibrating screen device and the dual belt conveyor-elevator are both foldable from an elevated operating position to a retracted transport or storage position. The portable crushing and screening plant of the invention has particular utility for processing of gravel or stone for commercial use, including sizing and sorting such gravel or stone, but may also be used for processing other material such as mineral ore.

7 Claims, 6 Drawing Figures

PORTABLE CRUSHING AND SCREENING PLANT

This is a continuation of application Ser. No. 122,457, filed Feb. 19, 1980, now abandoned which was a continuation of application Ser. No. 941,084 filed Sept. 11, 1978 now abandoned.

TECHNICAL FIELD

This invention relates to a vehicle-mounted closed circuit portable crushing and screening plant in which a plurality of units for processing material to be crushed and screened, such as a grizzly, a primary crusher, a secondary crusher, and a screening device are mounted on the vehicle, with the grizzly and the primary and secondary crushers discharging their outputs onto a conveyor system mounted on the vehicle and which delivers the material to the screening device for recirculation and/or for discharge as end product or products. The portable crushing and screening plant of the invention has particular utility for processing gravel or stone for commercial use, including sizing and sorting the gravel or stone, but may also be used for crushing and screening other material such as mineral ore including iron ore or the like.

BACKGROUND OF THE PRIOR ART

It has been known in the prior art to provide a portable crushing and screening plant in which a plurality of devices for processing material to be crushed are positioned in overlying and discharging relation to a first conveyor, which first conveyor then discharges the material which has been deposited upon it onto a second conveyor which elevates the material being processed and deposits such material through the intermediary of still another conveyor into the upper feed end of an inclined vibrating screening device which classifies the material thus deposited on the vibrating screening device for recirculation and/or for discharge from the screening device as one or more end products of predetermined size. Such an arrangement is shown, for example, by U.S. Pat. No. 2,593,353 issued to Harry J. Shelton, Jr. on Apr. 15, 1952.

BRIEF SUMMARY OF THE INVENTION

It is an object of the present invention to provide a portable closed circuit crushing and screening plant for mounting on a vehicle and including an apparatus for processing a material which is being crushed, and further including a dual belt conveyor-elevator including a normally horizontal feeder portion which receives the output product of the apparatus and an elevator portion which receives material from the horizontal feeder portion and which elevates the material to the inlet end of a screening device which classifies the material either for purposes of recirculation to the aforesaid apparatus or for discharge to at least one end product discharge outlet of the screening device.

It is another object of the invention to provide a mobile crushing and screening plant which is particularly useful for processing gravel or stone or the like but which may also be used for processing other material such as mineral ore, the portable crushing and screening plant including a processing apparatus for processing material which is being crushed, the portable crushing and screening plant additionally including a vibrating screening device and a dual belt conveyor-elevator which delivers the output product of the aforesaid processing apparatus to the input end of the screening device, with the screening device and the conveyor-elevator both being structurally arranged to be moved from an extended "in use" position to a retracted transport position.

It is another object of the present invention to provide a portable closed circuit crushing and screening plant for mounting on a vehicle and including a plurality of devices for processing the material which is being crushed, such as a grizzly, a primary crusher and a secondary crusher, and further including a dual belt conveyor-elevator including a normally horizontal feeder portion which receives the output product of the grizzly and of the primary and secondary crushers, and an elevator portion which receives material from the horizontal feeder portion and which elevates the material to the inlet end of an inclined screening device which classifies the material either for purposes of recirculation or for discharge to at least one end product discharge outlet of the screening device.

It is a further object of the invention to provide a portable crushing and screening plant adapted to be mounted on a vehicle both for transport and also while the crushing plant is in operation, and particularly useful for processing gravel or stone or the like but which may also be used for processing other material such as mineral ores, the portable crushing and screening plant including a group of material processing devices such as a grizzly, a primary crusher and a secondary crusher, all of which have a relatively fixed structural position on the portable crushing and screening plant, with the portable crushing and screening plant additionally including an inclined vibrating screening device and a dual belt conveyor-elevator which delivers the output product of the grizzly and of the primary and secondary crushers to the input end of the screening device, with the screening device and the conveyor-elevator both being structurally arranged to be moved from an extended "in use" position to a retracted transport position.

In achievement of these objectives, there is provided in accordance with the invention a closed circuit portable crushing and screening plant adapted to be mounted on a vehicle, said portable plant comprising an apparatus for processing raw material to be crushed, said apparatus including an outlet through which a product of said processing is discharged, a screening device, a dual belt conveyor-elevator including a substantially horizontal feeder portion and an elevator portion, said horizontal feeder portion being positioned to receive said product of said processing which is discharged by said apparatus, said horizontal feeder portion being adapted to deliver material deposited thereon to said elevator portion, said elevator portion being adapted to elevate material received from said horizontal feeder portion and to discharge the material thus elevated onto said screening device, said screening device being adapted to classify the material deposited thereon into a first component which is recirculated to said apparatus for further processing and into at least one additional component which is discharged from said screening device as an end product.

Further objects and advantages of the invention will become apparent from the following description taken in conjunction with the accompanying drawings in which:

DETAILED DESCRIPTION OF THE INVENTION

Figure 1:
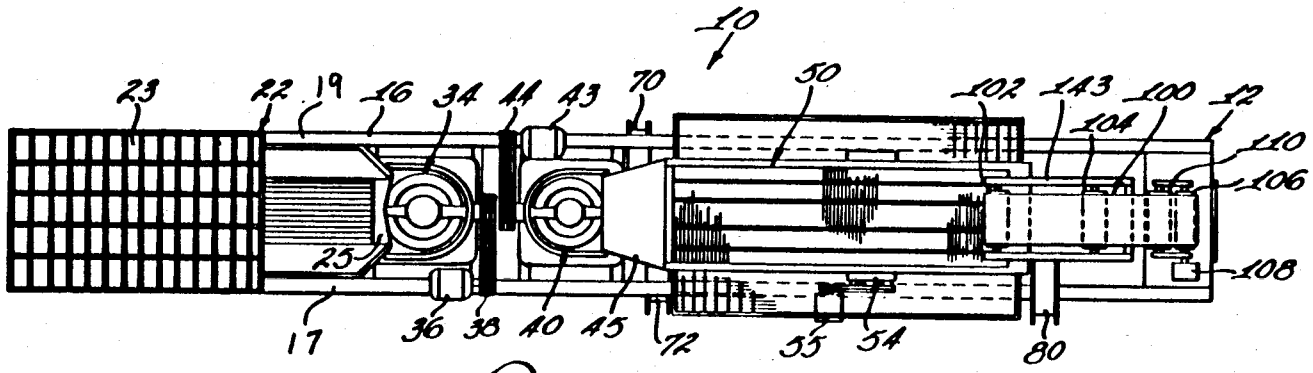
FIG. 1 is a top plan view of the portable crushing and screening plant of the invention with the plant being shown in operating position.
Figure 2:
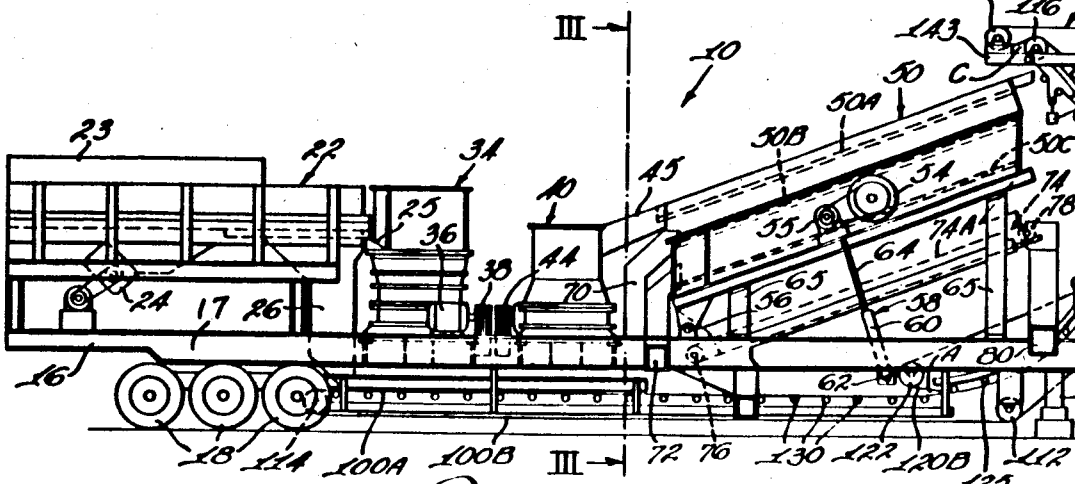
FIG. 2 is a side elevation view of the portable crushing and screening plant of FIG. 1.
Figure 3:
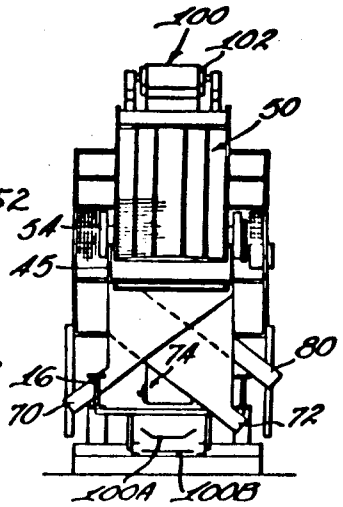
FIG. 3 is a section view of the portable crushing and screening plant taken along line III—III of FIG. 2.

Referring now to the drawings and more particularly to FIGS. 1—3, inclusive, which show the portable crushing and screening plant in "in use" or operating position, the portable crushing and screening plant is generally indicated at 10, and includes a trailer 12 adapted to be towed by a tractor 14. In the "in-use" or operative position of FIGS. 1—3, inclusive, tractor 14 is detached from trailer 12. Trailer 12 includes a chassis 16 supported at the rearward portion thereof by wheels 18 and at the forward portion thereof when in the operating position by a jack 20 which is extended into ground-engaging position before tractor 14 is disconnected from trailer 12. The chassis 16 is essentially an elongated horizontal frame having a pair of parallel, spaced main horizontal I-beams 17, 19.

A vibrating grizzly generally indicated at 22, and which may be of the well-known bar type grizzly is mounted on the rear portion of chassis 16 and is provided with a vibrating mechanism 24 driven by a suitable power means. Grizzly 22 serves as a feeder for portable crushing and screening plant 10. Grizzly 22 includes a grate 23 upon which the raw material such as gravel, stone, or mineral ore, is placed. Pieces of the raw material which are too large to be crushed by primary crusher 34 (to be described) are retained on grate 23. The remaining portion of the raw material passes through grate 23 into the hopper of grizzly 22 and the grizzly separates such material into two components as follows: (1) fines which are too small to be fed to the primary crusher 34; and (2) "oversize" material which is to be fed to primary crusher 34.

The rate of feed of material passing through grizzly 22 may be controlled by controlling the frequency of vibration of vibrating mechanism 24. Also, the size of the material passing through the grizzly to primary crusher 34 may be controlled to some extent by adjustment of the spacing of the grizzly bars.

Grizzlys are per se well known in the prior art and are shown, for example, by U.S. Pat. No. 2,321,166 issued to Loren G. Symons on June 8, 1943; by U.S. Pat. No. 2,831,270 issued to Walter J. Hartwig on Apr. 22, 1958; and by U.S. Pat. No. 3,106,523 issued to Rene' Couture on Oct. 8, 1963.

The fines are discharged from grizzly 22 through a discharge chute 26 onto the upper surface of the horizontal run or feeder portion 100A of the outer belt conveyor 100 of a dual belt conveyor-elevator 30 which will be described more fully hereinafter. Grizzly 22 discharges the "oversize" component of the raw material through a suitable chute 25 to the inlet of primary gyratory crusher generally indicated at 34. Gyratory crusher 34 is driven by a motor 36 through a belt drive 38. Primary gyratory crusher 34 crushes the oversize material delivered to it from grizzly 22 to a predetermined size and discharges its output onto the upper surface of horizontal feeder portion 100A of outer belt conveyor 100 of dual belt conveyor-elevator 30.

Portable crushing and screening plant 10 also includes a secondary gyratory crusher 40 mounted on trailer chassis 16 contiguous but forwardly of primary crusher 34 relative to the tractor end of the portable plant. Secondary crusher 40 is adapted to receive and crush material of a smaller size than that crushed by primary crusher 34. Secondary crusher 40 is suitably driven by motor 43 through a belt drive 44.

Crushing and screening plant 10 also includes a three-deck vibrating screen apparatus generally indicated at 50 including a top screen deck 50A which is adapted to discharge material retained thereon into the inlet or feed end of secondary crusher 40 for recycling. Multiple deck vibrating screen 50 is vibrated by vibrating mechanism 54 which is rotatably driven by motor 55. Vibrating screen 50 is pivotally-connected to the vehicle chassis structure at pivot point 56 at the lower end of the discharge end of screen 50. To permit vibrating screen 50 to be pivotally moved about its pivotal connection 56 from the substantially horizontal transport position shown in FIGS. 4 and 5 to the inclined "in-use" position shown in FIGS. 1–3, inclusive, a hydraulic actuator or jack generally indicated at 58 is provided having a hydraulic cylinder 60 which is pivotally connected at point 62 to chassis structure 16. Ram 58 includes a piston rod 64 which is moved to the extended position shown in FIG. 2 to raise screening device 50 to the inclined operative position shown in FIG. 2. Detachable vertical support members 65 may be used to aid in supporting screen 50 in upwardly inclined operating position of screen 50 shown in FIG. 2. Support members 65 may be detached and removed when screen 50 is in the transport position shown in FIG. 4.

Secondary crusher 40 is provided with an inlet chute 45 which is adapted to line up with the discharge end of top screen deck 50A of vibrating screen 50 when vibrating screen 50 is in the inclined operative position shown in FIG. 2.

In addition to top screen deck 50A, vibrating screen 50 also includes a second screen deck 50B having a discharge end which communicates with and discharges into the stationary side discharge chute 70 mounted on chassis 16. Vibrating screen 50 also has a third screen deck 50C having a discharge end which communicates with and discharges into stationary side delivery chute 72.

A transfer conveyor generally indicated at 74 is positioned in underlying relation to third screen deck 50C. Transfer conveyor 74 is suitably secured to the understructure of the multiple deck vibrating screen apparatus 50 and in effect is a component part of the screen apparatus 50. Thus, transfer conveyor 74 moves upwardly with screen 50 about pivot point 56 to the inclined operating position shown in FIGS. 2 and 6, and moves downwardly with screen 50 about pivot point 56 to the substantially horizontal transport position of FIG. 4.

Transfer conveyor 74 has an upper run 74A adapted to receive the fines which pass through the openings of third screen deck 50C. Transfer conveyor 74 is trained around longitudinally spaced roller members 76 and 78 and is driven by a suitable independent motor means in such a direction that when the portable plant is in operative position as seen in FIG. 2 upper run 74A of transfer conveyor 74 moves upwardly at an inclination in a left-to-right direction with respect to the view shown in FIG. 2 to discharge the fines collected on upper run 74A of the transfer conveyor into side discharge chute 80. Side discharge chute 80 is a detachable removable member which is positioned as shown in FIG. 2 during operation of crushing and screening plant 10, but is removed when the plant is in the transport position shown in FIG. 4.

It can be seen from the section view of FIG. 3 that the three side discharge chutes 70, 72 and 80 extend laterally of trailer chassis 16 at an inclination so as to be able to discharge onto corresponding conveyor belts (not shown) mounted on the ground, and which convey the material deposited thereon to corresponding stockpiles. Of course, the material discharged by the respective side discharge chutes 70, 72 and 80 can be delivered to other appropriate receiving devices such as trucks or the like.

The dual belt conveyor-elevator or "Loop Belt" conveyor generally indicated at 30 which receives the outputs of grizzly 22, of primary crusher 34, and of secondary crusher 40 and which conveys and elevates these outputs to the input end of vibrating screen 50 is generally similar to the dual belt conveyors disclosed in U.S. Pat. No. 3,805,946 issued to Earl W. Yateman et al on Apr. 23, 1974, and in U.S. Pat. No. 4,007,826 issued to Scott L. Brown, Jr. et al on Feb. 15, 1977. Dual belt conveyor 30 includes an outer belt conveyor generally indicated at 100 in the form of an endless loop which operates around pulleys 102, 104, 106, 110, 112, 114, and 116 to define the outer belt loop. The inner belt conveyor generally indicated at 120 passes over pulleys 116, 117, 119, 121, 126, 128, and 122 to define the inner belt loop. Outer belt conveyor 100 is driven by pulley 106, which in turn is driven by a suitable drive means 108. Inner belt conveyor 120 is driven by outer belt conveyor 100 through friction between outer belt conveyor 100 and inner belt conveyor 120.

Outer belt conveyor 100 includes a work run 100A with a long substantially horizontal "feeder" portion which extends from a position just slightly upstream or to the left, as viewed in FIG. 2, with respect to the discharge outlet of discharge chute 26 of grizzly 22, where the return run 100B of outer belt conveyor 100 passes around pulley 114. As illustrated, the rear end of the longitudinally extending portion of the working run 100A is adjacent the wheels 18 supporting the rear end of the elongated frame 16. The longitudinally extending portion of the working run 100A extends forward below the horizontal frame 16 in general horizontal alignment with the wheels 18. Material from grizzly 22 and crushers 34 and 40 is deposited onto the upper surface of the substantially horizontal feeder run 100A. Outer belt conveyor 100 is driven in a clockwise direction relative to the view in FIG. 2 whereby horizontal feeder portion 100A of outer belt conveyor 100 moves in a left-to-right direction with respect to the view of FIG. 2. Horizontal feeder portion 100A of outer belt conveyor 100 is supported for substantially its entire length by troughing rollers 130. Horizontal feeder portion 100A while being substantially horizontal need not be absolutely horizontal but can be inclined at an angle of up to about 18 degrees, as pointed out in the aforementioned U.S. Pat. No. 3,805,946 of Earl W. Yateman et al.

In order to compensate for belt stretch and to maintain outer belt conveyor 100 under tension at all times, pulley 114 is connected to an automatic tensioning device diagramatically indicated at 135 (FIG. 6) which applies a constant horizontal force to pulley 114.

Inner belt conveyor 120 includes an upwardly extending forward run 120A (FIG. 2) which extends between pulleys 122 and 116.

Forward run 120A of inner belt conveyor 120 includes a short downwardly facing portion 120B which together with horizontal upper run 100A of outer belt conveyor 100 defines a bight through which material deposited on upper run 100A of outer belt conveyor 100 passes between outer and the inner conveyor belts 100 and 120, respectively, to be clamped thereby.

The greater part of the length of forward run 120A of inner belt conveyor 120 is supported by a series of troughing rollers 125. Troughing rollers 125 are troughed in such manner as to maintain the upwardly extending portions of inner and outer belt conveyors 120 and 100 in sealing engagement at the edges of the respective belt conveyors to prevent escape of the sandwiched material being conveyed between the upwardly moving portions of the two belt conveyors.

In order to compensate for belt stretch and to maintain inner belt conveyor 120 under tension at all times the return run 120B of inner belt conveyor 120 is connected to an automatic tensioning device diagrammatically indicated at 137 which applies a constant tensioning force to inner belt conveyor 120.

The material being conveyed in the elevator portion of dual belt conveyor-elevator 30 is sandwiched between the facing surfaces of inner and outer belt conveyors 100 and 120 between point A contiguous the bight of the two belt conveyors as just explained to a discharge point indicated at C contiguous the upper end of the two belt conveyors where the conveyed material is discharged onto top screening deck 50A of vibrating screen device 50. The facing surfaces of the upwardly-moving portions of the outer conveyor belt 100 and of the inner conveyor belt 120 grip the material between the two conveyor belts and convey the material upwardly from point A contiguous the bight to discharge point C.

In the operative and elevating position of the dual belt or "Loop Belt" conveyor 30 shown in FIGS. 1 and 2, dual belt conveyor 30 is supported in its upright position by a two-part support structure generally indicated at 140. Support structure 140 comprises a lower vertical support section 140A which is suitably attached to trailer chassis 16 contiguous the forward end of chassis 16, and an upper support section 140B which is hinged at the lower end thereof to the upper end of lower support section 140A about a transverse hinge or pivot axis 142. At the upper end thereof, upper support portion 140B has secured thereto a horizontal bracket-like portion 143 which supports the outermost pulley 102 about which the outer end of outer belt conveyor 100 is trained. In the operating position of dual belt conveyor-elevator 30 shown in the views of FIGS. 1 and 2, the lower end of upper support section 140B rests on the upper end of lower support section 140A, with the two support sections 140A and 140B being in vertical alignment with each other to define a column-like member which supports the elevator portion of the dual belt conveyor-elevator 30 in its extended and elevated operating position, as seen in the views of FIGS. 1 and 2.

DESCRIPTION OF OPERATION

Figure 6:
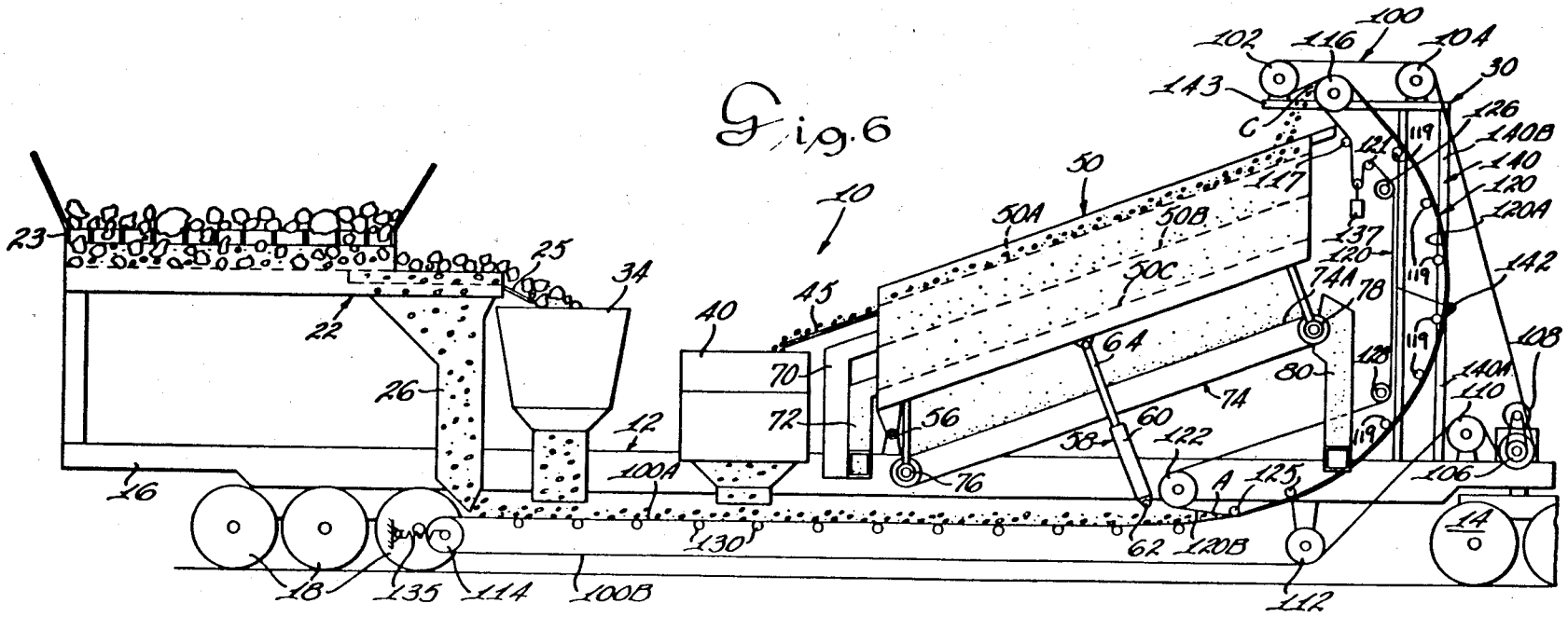
FIG. 6 is a diagrammatic view of the portable crushing and screening plant, showing the interrelation of the various components of the crushing and screening plant.

The operation of the portable crushing and screening plant can perhaps best be seen in the schematic diagram of FIG. 6. Raw material such as gravel, stone, or mineral ore is dumped onto grate 23 of grizzly 22. Pieces of the raw material which are too large to be crushed by primary crusher 34 are retained on grate 23. The remaining portion of the raw material passes through grate 23 into the hopper of grizzly 22 and the grizzly separates the fines from the raw material and discharges the fines through chute 26 onto the upper surface of horizontal feeder portion 100A of outer belt conveyor 100. The "oversize" component of the raw material is discharged by grizzly 22 through discharge passage 25 into primary gyratory crusher 34. Primary gyratory crusher 34 crushes the "oversize" which is fed to it from grizzly 22 to a predetermined size and discharges the crushed material onto the upper surface of horizontal feeder portion 100A of outer belt conveyor 100 at a location downstream of the location where fines from grizzly 22 are discharged onto horizontal feeder portion 100A. Material thus deposited by grizzly 22 and by primary gyratory crusher 34 onto horizontal feeder portion 100A of outer belt conveyor 100 is carried by horizontal feeder portion 100A to the bight portion defined between the forwardly extending runs of outer and inner belt conveyors 100 and 120, respectively, and the material received between these conveyors is sandwiched between the upwardly extending runs of inner and outer belt conveyors 100 and 120 which define the elevating portion of conveyor-elevator 30. The material is elevated by the elevating portion of conveyor-elevator 30 to discharge point C where the material thus conveyed is discharged onto top deck 50A of vibrating screen 50.

Material which is retained on upper deck 50A of vibrating screen 50 is recirculated by discharging such material from upper deck 50A into inlet chute 45 of secondary crusher 40 which crushes such recirculated material to a predetermined size and discharges it onto the upper surface of horizontal feeder portion 100A of outer belt conveyor 100 downstream of the discharge points of grizzly 22 and of primary crusher 34. The material discharged by secondary crusher 40 onto horizontal feeder portion 100A joins the material discharged by grizzly 22 and by primary crusher 34 and is conveyed along with these discharge products upwardly by the elevating portion of conveyor-elevator 30 to again be discharged onto top deck 50A of vibrating screen 50 either for further recirculation or alternatively for separation into end products by vibrating screen 50.

The material which passes through top screen deck 50A but is retained by second screen deck 50B is discharged at the lower end of screen deck 50B into stationary discharge chute 70 as an end product and is discharged by side discharge chute 70 onto a ground-mounted conveyor belt or the like (not shown). Typically, material discharged through side discharge chute 70 might be minus $\frac{7}{8}''$ plus $\frac{3}{8}''$. The material which passes through second screen deck 50B but is retained on third screen deck 50C is discharged from the lower end of third screen deck 50C and passes as an end product into side discharge chute 72, and may be received by another ground-mounted conveyor belt or the like (not shown). Typically, such end product might be minus $\frac{3}{4}''$ plus $\frac{1}{4}''$. Material which passes through third screen deck 50C and is received on the upper run of transfer conveyor 74 is carried upwardly by transfer conveyor 74 and is discharged into side discharge chute 80 where it may be received by still another ground-mounted conveyor belt or the like. Material passing through third screen deck 50C and onto transfer conveyor 74 and into side discharge chute 80 is classified as fines.

The closed circuit system just described insures that all of the raw material fed to the system by grizzly 22 (excluding the material retained on grate 23 of the grizzly) will ultimately be discharged as an end product through one of the side discharge chutes 70, 72, and 80.

Figure 4:
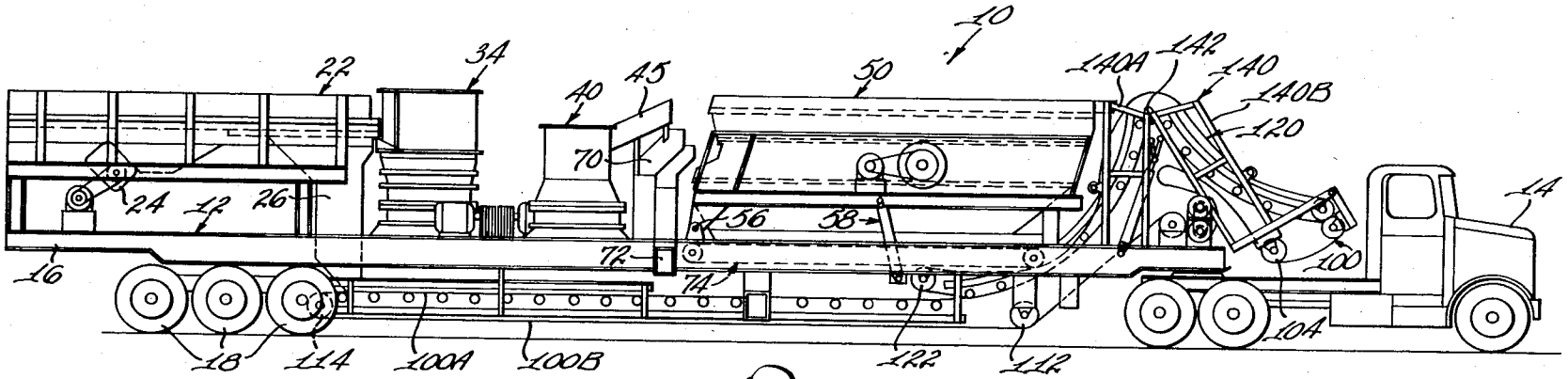
FIG. 4 is a side elevation view of the portable crushing and screening plant of the invention in transport position.
Figure 5:
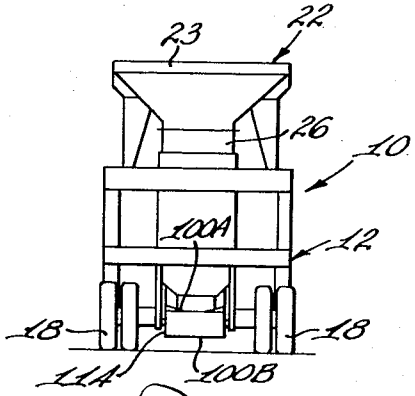
FIG. 5 is a rear end view of the portable crushing and screening plant in transport position.

When it is desired to place the apparatus in condition for transport, the support structure 140 for the elevating portion of conveyor-elevator 30 is folded downwardly from its elevated position as seen in FIGS. 1 and 2 by folding upper support section 140B in a clockwise direction relative to the views in the drawings about the transverse pivotal axis 142 (FIG. 2) to the downwardly folded position as seen in the transport position view of FIG. 4. Swinging movement of the upper support section 140B relative to the lower support section 140A about the transverse pivot axis 142 is effected by a power actuator in the form of a double acting hydraulic jack 151 which has its rod end pivotally connected to links 152, 153 on a single transverse axis (which links are pivotally connected to the upper and lower support sections 140B and 140A, respectively) and its cylinder end pivotally connected to the elongated frame or chassis 16. Also, hydraulic pressure in hydraulic cylinder 60 of hydraulic jack 58 (FIG. 2) is relieved, permitting piston rod 64 to retract into hydraulic cylinder 60, to thereby permit vibrating screen 50 to move downwardly about its pivotal connection 56 to trailer chassis 16 from the upwardly inclined operating position shown in FIG. 2 to the substantially horizontal transport position seen in the view of FIG. 4. Also, the downward pivotal movement of screen 50 about its pivotal axis 56 as just described imparts a similar downward movement to transfer conveyor 74 since transfer conveyor 74 is structurally connected to the understructure of screen 50, whereby to move transfer conveyor 74 to a horizontal transport position in parallel underlying relation to screen 50. Also for the transport position, tractor 14 is connected to the forward end of trailer 12 on which the portable crushing and screening plant is mounted, and jack 20 is retracted to a raised transport position permitting movement of the tractor-trailer combination.

From the foregoing detailed description of the invention, it has been shown how the objects of the invention have been obtained in a preferred manner. However, modifications and equivalents of the disclosed concepts such as readily occur to those skilled in the art are intended to be included within the scope of this invention.

The embodiments of the invention in which an exclusive property or privilege is claimed are defined as follows:

1. In a mobile material crushing and screening plant having an elongated frame and wheels mounted on and in supporting relation to the frame, the combination comprising:

a first screening device, a primary crusher, a secondary crusher and a second screening device mounted on said frame in longitudinal sequence in the order recited, an endless belt conveyor on said frame having a main endless belt with a working run having a longitudinal extending portion extending horizontally in the elongated direction of said frame beneath said screening devices and crushers, said working run having a curved segment curving upwardly in an arc from beneath said second screening device, thence adjacent the receiving end of said second screening device, said receiving end being more remote from a selected end of said frame than the discharge end of said second screening device, said curved segment of said working run of said endless belt terminating above said receiving end of said second screening device, said conveyor including an endless cover belt having a working run cooperatively engaging said curved segment of said working run of said main endless belt, said first screening device being operable to separate the material deposited thereon into fines and oversize material and to feed the oversize material to said primary crusher and the fines to said working run of said main endless belt disposed therebelow, said primary crusher being operable to crush said oversize material and discharge its output onto said working run of said main endless belt, said secondary crusher discharging its output onto said working run of said main endless belt, said belt conveyor being operable to convey the material received from said first screening device, said primary crusher and said secondary crusher and discharge it directly onto said receiving end of said second screening device, said second screening device being operable to separate material delivered thereto by said belt conveyor into oversized material which it delivers directly to said secondary crusher and fines which do not require additional crushing which it delivers to discharge means, said secondary crusher receiving exclusively said oversize material from said second screening device and discharging its output onto said working run of said main endless belt and a generally upright support structure for supporting a major portion of said curved segment of said working run of said main belt, said support structure having a lower section secured to said frame and an upper section pivoted on a transverse axis at its lower end to the upper end of said lower section, said upper section being swingable from an upright operating position downwardly about said transverse axis to a lowered transport position.

2. The mobile plant of claim 1 and further comprising a power actuator operatively interposed between said upper section and said frame operable to swing said upper section between its upright operating position and its lowered transport position.

3. The mobile plant of claims 1 or 2 wherein said second screen device is connected by a pivotal connection to said elongated frame, said second screening device being movable about said pivotal connection to an upwardly inclined position for operation, and being pivotally movable downwardly from said upwardly inclined operating position about said pivotal connection to a lowered transport position.

4. The mobile plant of claim 3 and further comprising a hydraulic actuator operatively interposed between said second screening device and said frame operable to move said second screening device between its lowered transport position and its upwardly inclined operating position.

5. A mobile material crushing and screening plant comprising:

an elongated frame, ground engaging wheels mounted on said frame in supporting relation to the latter, crushing apparatus including a primary crusher and a secondary crusher both mounted on said frame intermediate the longitudinal ends thereof, a first screening device mounted on said frame adjacent one end thereof operable to separate material deposited thereon into an oversize component which it feeds to said primary crusher and an undersize component, a second screening device mounted on said frame on the side of said crushing apparatus remote from said one end of said frame, said second screening device being operable to classify material deposited thereon into an oversize component which it feeds directly to said secondary crusher and fines which it feeds to predetermined discharge chute means, and an endless belt conveyor on said frame having a main endless belt with a working run having a longitudinally extending portion extending horizontally in the elongated direction of said frame beneath said screening devices and crushers so as to receive the fines from said first screening device and the output of said crushers, said working run having an arcuate segment curving upwardly in an arc from beneath said second screening device, thence adjacent the end of said second screening device remote from said one end of said frame and terminating above said second screening device so as to deliver material directly to said second screening device for separation thereby, said conveyor including an endless cover belt having a working run cooperatively engaging the arcuate segment of the working run of the main endless belt, said conveyor including a generally upright support structure supporting a major portion of said arcuate segment of said working run of said main belt and said cover belt, said support structure having a lower section secured to said frame and an upper section pivoted on a transverse axis at its lower end to the upper end of said lower section, said upper section being swingable from an upright operating position downwardly about said transverse axis to a lowered transport position.

6. The mobile plant of claim 5 and further comprising a power actuator operatively interposed between said upper support section and said frame operable to swing said upper support section between its upright operative position and its lowered transport position.

7. The mobile plant of claims 4 or 5 wherein said second screening device is connected by a pivotal connection to said elongated frame, said second screening device being movable about said pivotal connection to an upwardly inclined position for operation and being pivotally movable downwardly from said upwardly inclined operating position about said pivotal connection to a lowered transport position.

* * * * *